US012048963B2

(12) United States Patent
Dechassey et al.

(10) Patent No.: US 12,048,963 B2
(45) Date of Patent: Jul. 30, 2024

(54) HOLED INGOT IMPROVING A LINE PRODUCTIVITY

(71) Applicant: ArcelorMittal, Luxembourg (LU)

(72) Inventors: Emmanuel Dechassey, Godella Valencia (ES); Woudhouh Memni, Thionville (FR); Patrice Vicente-Hernandez, El Puig Valencia (ES)

(73) Assignee: ArcelorMittal, Luxembourg (LU)

( * ) Notice: Subject to any disclaimer, the term of this patent is extended or adjusted under 35 U.S.C. 154(b) by 186 days.

(21) Appl. No.: 17/610,746

(22) PCT Filed: May 12, 2020

(86) PCT No.: PCT/IB2020/054479
§ 371 (c)(1),
(2) Date: Nov. 12, 2021

(87) PCT Pub. No.: WO2020/230021
PCT Pub. Date: Nov. 19, 2020

(65) Prior Publication Data

US 2022/0250139 A1 Aug. 11, 2022

(30) Foreign Application Priority Data

May 13, 2019 (WO) ..... PCT/IB2019/053931

(51) Int. Cl.
*B22D 7/00* (2006.01)
*B22D 7/04* (2006.01)
(Continued)

(52) U.S. Cl.
CPC ..... *B22D 7/04* (2013.01); *C23C 2/003* (2013.01); *C23C 2/34* (2013.01); *Y10T 428/12222* (2015.01)

(58) Field of Classification Search
CPC .... Y10T 428/12229; Y10T 428/12222; B22D 7/14
See application file for complete search history.

(56) References Cited

U.S. PATENT DOCUMENTS 1,950,633 A 12/1967 Schmeller
3,356,465 A 12/1967 Chambran
(Continued)

FOREIGN PATENT DOCUMENTS

JP S546814 A 1/1979
KR 100683194 B1 2/2007
(Continued)

OTHER PUBLICATIONS

See Search Report of PCT/IB2020/054479 dated Jun. 16, 2020.
Written opinion for PCT/IB2020/054479.

*Primary Examiner* — Adam Krupicka
(74) *Attorney, Agent, or Firm* — Davidson Kappel LLC

(57) ABSTRACT

An ingot, having a volume between 0.15 $m^3$ and 0.80 $m^3$ and a surface area to volume ratio between 10 $m^{-1}$ and 18 $m^{-1}$, made of at least one metal, having longitudinal faces extending between two end faces and including at least one hole extending from one of the longitudinal faces, the maximum distance between any point of the hole periphery, to its closest longitudinal face, noted MaxL, the at least one hole being configured such that said maximum distance MaxL is smaller than the minimal distance, noted MinE, between any point of the hole periphery and its closest end face.

8 Claims, 5 Drawing Sheets

(51) Int. Cl.
*C23C 2/00* (2006.01)
*C23C 2/34* (2006.01)

(56) References Cited

U.S. PATENT DOCUMENTS 3,671,204 A 6/1972 Foley et al.
3,674,444 A * 7/1972 Otani ..... C22B 1/248
428/599
4,839,236 A 6/1989 Sulprizio et al.

FOREIGN PATENT DOCUMENTS

KR 2013 0062185 A 6/2013
WO WO 2020/230058 A1 11/2020

* cited by examiner

HOLED INGOT IMPROVING A LINE PRODUCTIVITY

The present invention relates to a metallic ingot permitting to reduce the formation of dross and to increase a coating line productivity by improving the ingot melting rate and easing the line management while keeping satisfactory ingot mechanical properties.

BACKGROUND

Nowadays, most of the metallic products are coated to enhance their properties, especially their surface properties. Such coatings are generally alloys primarily based on aluminium and/or zinc. As represented in FIG. 1, one of the most common coating processes is the hot-dip, wherein the product to be coated 1 (eg.: a band, a strip or a wire) is dipped into a bath of molten metal 2, contained in a tank 3, which will adhere to the product surface and then form a desired coating. Said product is generally continuously passed through the bath by means of conveying means and an immerged roll 4.

Furthermore, because the product leaves the bath with a coating layer, the bath level decreases if not supplied in coating material. Consequently, the bath should be fed regularly to maintain or at least regulate the bath level at a desired level. This feeding can be done through ingot addition wherein an ingot 5 is introduced into the bath 2 at a controlled rate using an insert table 6 and a holding or inserting mean 7.

As more of the product exits the bath, more coating is deposited, and more molten metal leaves the bath. The more rapidly the product leaves the bath, the more rapidly the bath level decreases. So, for a higher coating line productivity, the required feeding rate is higher in order to maintain the bath at a desired level.

The ingot supply into the bath is commonly, but not necessarily, done in three steps. Firstly, the ingot is handled from a storage location to an introduction position, where the ingot is usually held by a holder 6 and positioned on an insert table 5. Secondly, the ingot is introduced little by little into the bath 2 until the ingot portion 8 where the ingot is held melts. At that moment, the non-melted portion of the ingot, usually the core, falls to the tank bottom. Even though the ingot is introduced step by step, it is not completely melted at the end of the second step except in rare cases such as for low productivities. Thirdly, the ingot at the tank bottom melts.

SUMMARY OF THE INVENTION

During the ingot melting, its shape will evolve into different shapes, represented in FIG. 2 by modelled ingot shapes A to D. Only a half of an ingot is modelled because a symmetrical behaviour is expected for the other half, said half is along the ingot length. The shape A represented the ingot shape at the end of the step 2, when the ingot is completely immersed. The shapes B to D represent ingot shapes after a determined complete immersion time in the molten metal bath: B: 10 min—C: 20 min—D: 25 min. This sequence and the calculated ingot are calculated for an ingot having a length of 2150 mm, a solidus temperature of 575° C., a liquidus temperature of 601° C., during a feeding process in a molten metal bath of 650° C. made of the following steps:

1) A first sequence of immersion: 4 s immersion of 30 mm+25 s maintain,

2) Repeat said sequence 71 times to completely immerse the ingot (end of step 2 corresponds to A in FIG. 2), 3) Maintain the whole ingot immersed and wait for its complete melting (B, C and D in FIG. 2).

As modelled and represented in FIG. 2, an ingot fed during an industrial sequence can take more than 30 min to completely melt so one or several ingots can be present and/or pile at the tank bottom. Of course, said melting time depends on the sequence of immersion, the ingot and bath properties and the process condition. For example, the thermal bath properties depend on the bath composition, e.g. for a zinc-based bath, the temperature is generally around 470° C. and for an Alusi-based bath, the bath temperature is around 650° C.

However, the presence of one or several ingots at the bottom of the tank leads to several drawbacks for the coating quality because it generates a so called "cold point" in the bath leading among other things to dross formation which eventually lower the coating quality. Moreover, if there are too many ingots at the tank bottom, they may pile and enter in contact with the product to be coated leading to catastrophic consequence for the strip quality and the coating installation.

Consequently, to increase a coating line productivity, the ingot pile formation must be reduced or hindered.

It is an object of the present invention to provide a solution solving the aforementioned problems.

The present invention provides an ingot (10), having a volume between 0.15 $m^3$ and 0.80 $m^3$ and a surface area to volume ratio between 10 $m^{-1}$ and 18 $m^{-1}$, made of at least one metal, having longitudinal faces (13) extending between two end faces (14*a*, 14*b*) and comprising at least one hole (11) extending from one of said longitudinal faces (13) to a second longitudinal face, the maximum distance between any point of the hole periphery (110), to the closest longitudinal face (13), being noted MaxL, said at least one hole being configured such that said maximum distance MaxL is smaller than the minimal distance, being noted MinE, between any point of the hole periphery and the closest end face (14*a*, 14*b*).

The present invention also provides a process for managing a bath level of a molten alloy and reducing the dross formation inside a tank wherein an ingot, as described above, is fully immersed into the bath.

Other characteristics and advantages of the invention will become apparent from the following detailed description of the invention.

BRIEF DESCRIPTION OF THE DRAWINGS

To illustrate the invention, various embodiments and trials of non-limiting examples will be described, particularly with reference to the following figures.

DETAILED DESCRIPTION

Figure 3:
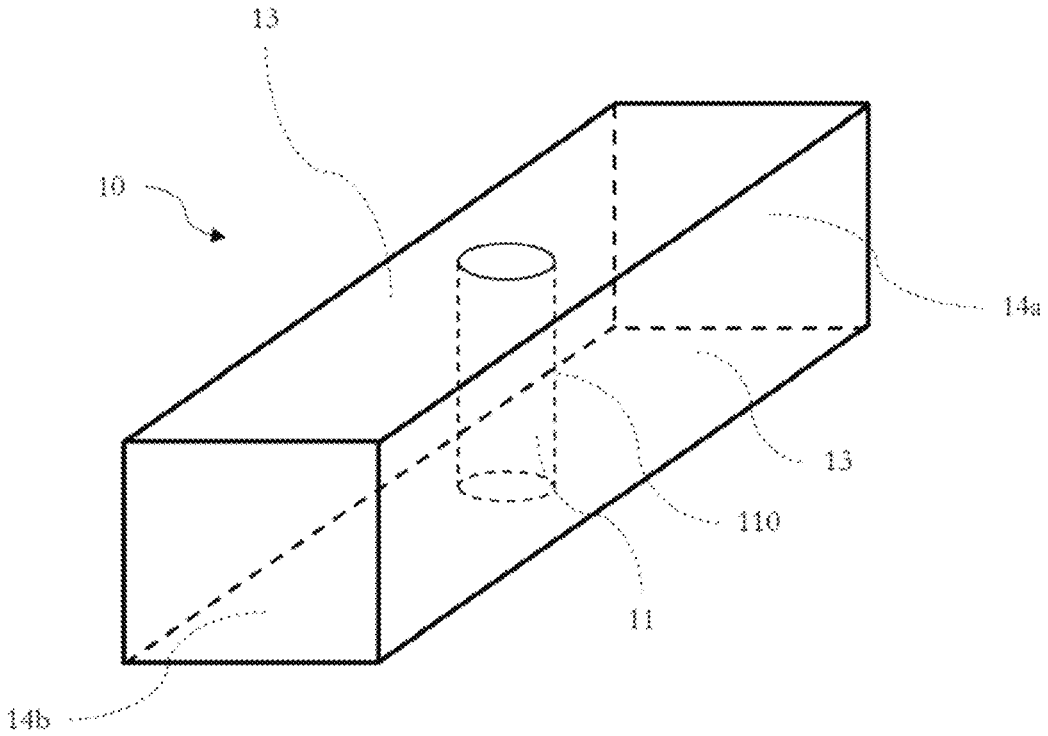
FIG. 3 is a schematic view of an embodiment of the present invention.
Figure 4A:
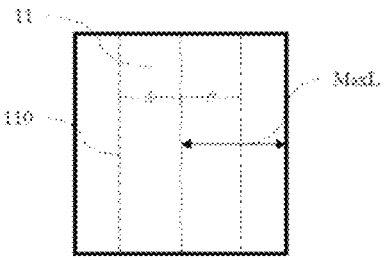
FIG. 4A exhibits a front view (A) and FIG. 4B a top view (B) of an embodiment of the present invention.
Figure 4B:
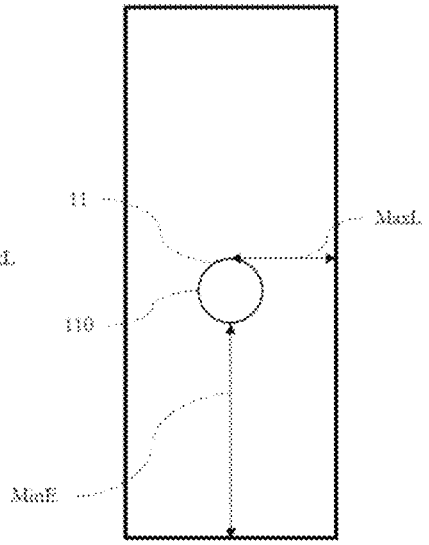

As illustrated in FIGS. 3 and 4A and 4B, the invention relates to an ingot 10, having a volume between 0.15 $m^3$ and 0.80 $m^3$ and a surface area to volume ratio between 10 $m^{-1}$ and 18 $m^{-1}$, made of at least one metal, having longitudinal faces 13 extending between two end faces (14*a*, 14*b*) and comprising at least one hole 11 extending from one of said longitudinal faces 13 to a second longitudinal face, the maximum distance between any point of the hole periphery 110, to the closest longitudinal face (13), being noted MaxL, said at least one hole being configured such that said maximum distance MaxL is smaller than the minimal distance, being noted MinE, between any point of the hole periphery and the closest end face (14*a*, 14*b*). The ingot is defined by a length which is bigger than the height and the width of said ingot. In the case where the ingot cannot be clearly defined by a length, a width and a height, for example an egg or pyramidal form, the projection of such ingot on a surface can be used to define a width and a height and the length can be defined as the maximum distance between two points of the ingot.

Said ingot has a volume between 0.15 $m^3$ and 0.80 $m^3$. On one hand, if the ingot volume exceeds 0.80 $m^3$, the ingot might be difficult to transport, stock, handle and/or used by the supplying mean of the coating line. On the other hand, if the ingot volume is lower than 0.15 $m^3$, the productivity might be negatively impacted because the time taken to handle and place the ingot on the supplying mean will be too high compared to the ingot melting time.

Said ingot has a surface area to volume ratio between 10 $m^{-1}$ and 18 $m^{-1}$. On one side, if this ratio is lower than 10 $m^{-1}$, it lowers the melting rate of the ingot due to a low exchange surface between the ingot and the molten metal bath which negatively impacts the line productivity and the bath management due to the risk of ingot pile formation at the tank bottom. On the other side, if this ratio exceeds 18 $m^{-1}$, considering the claimed ingot, it would apparently weaken the choc resistance of the ingot and thus increase the ingot breakage risk.

Figure 1:
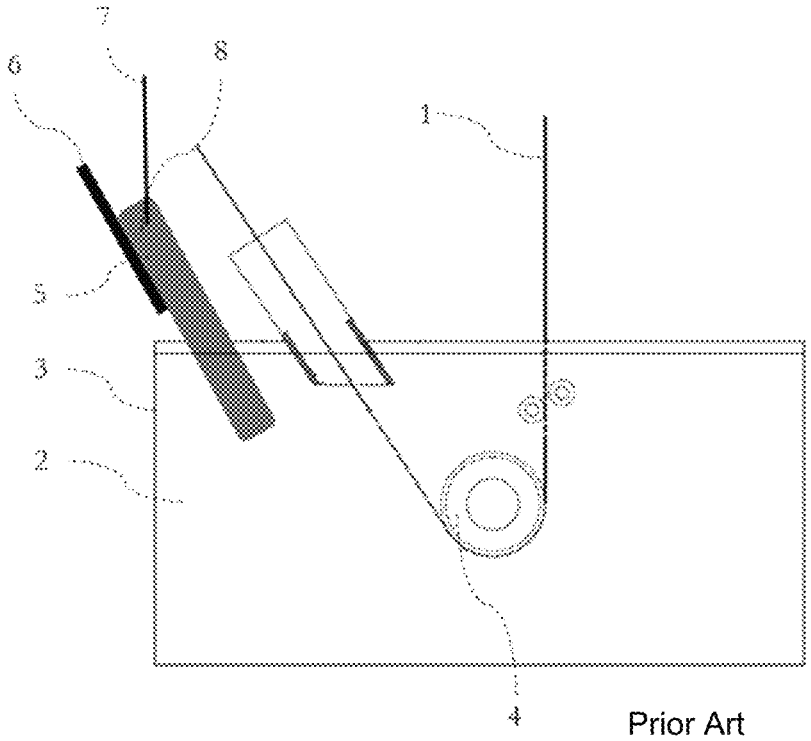
FIG. 1 is a schematic view of a classical coating installation.
Figure 2:
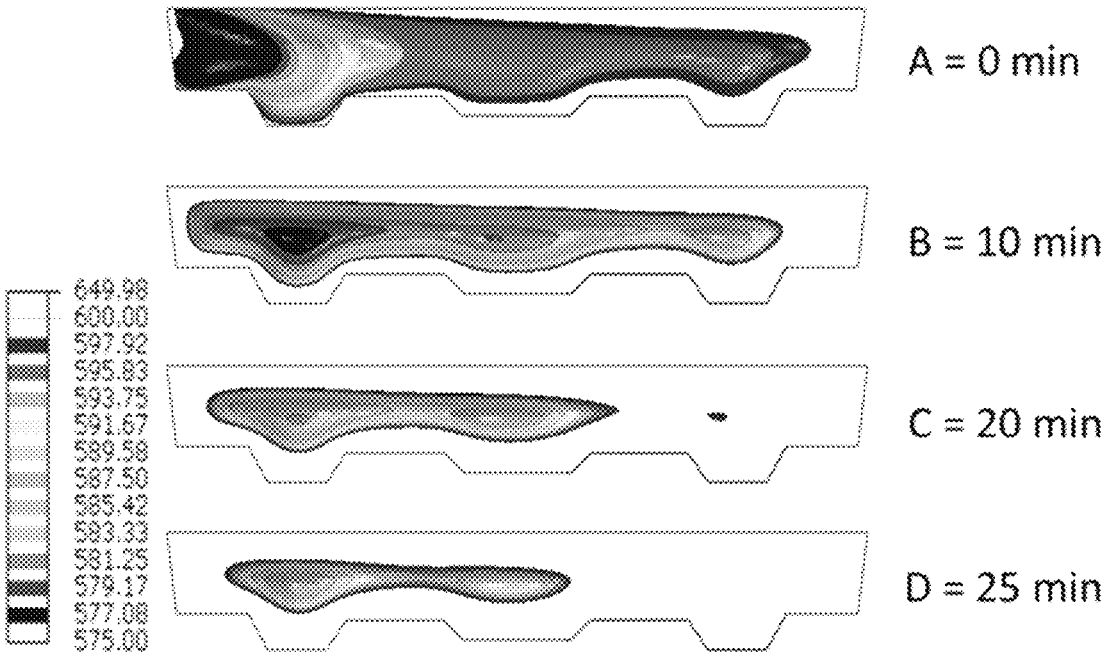
FIG. 2 exhibits several modelled ingot shapes during an ingot feeding process in determined industrial process condition for an embodiment of a classical ingot at determined melting times.
Figure 5:
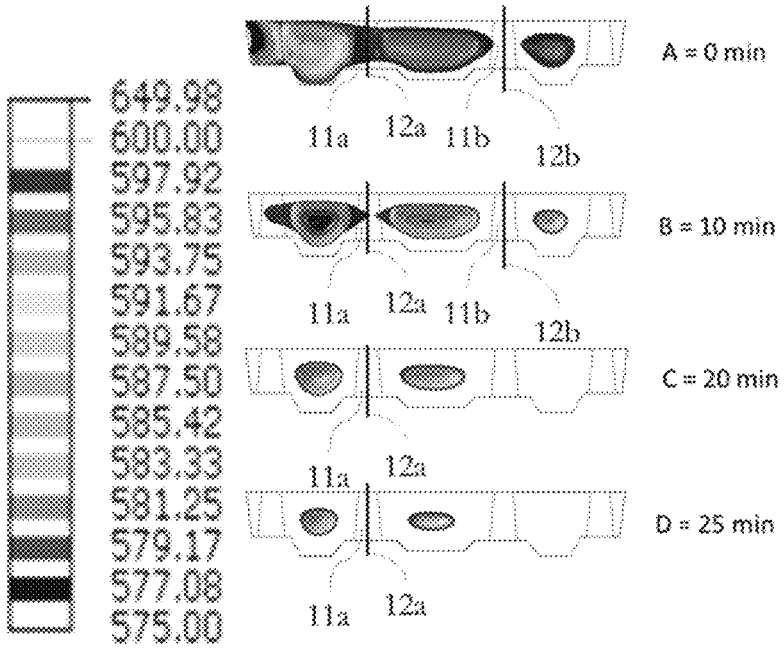
FIG. 5 exhibits several modelled ingot shapes during an ingot feeding process in determined industrial process condition for an embodiment of the present invention at determined melting times.

Driven by the idea of reducing the ingot melting time and the ingot pile formation, an ingot comprising a hole as previously described is particularly interesting for two main reasons. Firstly, such a hole permits to fragment the ingot into several pieces during its supply. As illustrated in FIG. 5, said fragmentation is done in the plans (12*a* and 12*b*) comprising holes (11*a* and 11*b*) and perpendicular to the ingot length of said ingot. In FIG. 5, said fragmentation is modelled for the same condition as in the FIG. 1. The time noted, from 0 to 25 min, is the time during which the ingot is completely immersed. Thanks to this fragmentation, the surface exchange between the molten metal bath and the ingots is increased and so is the ingot melting rate. Secondly, said claimed ingot is easy to cast, even from an existing mould. For example, a part can be added inside the mould to have the desired hole.

Consequently, the melting speed of the ingot is hence increased which reduces the formation of ingots pile at the bottom of said tank permitting to increase a line productivity and the coating quality and to reduce the dross formation.

The hole can have the form of a cone, a cylinder, a cylinder of revolution, a portion of a sphere. Said holes are solely used for increasing the ingot melting speed. Said holes are not used for handling nor for inserting the ingot into the bath.

The claimed ingot is made of at least one metal. Preferably, the ingot is at least made of zinc and/or silicon and/or magnesium and/or aluminium.

Figure 6:
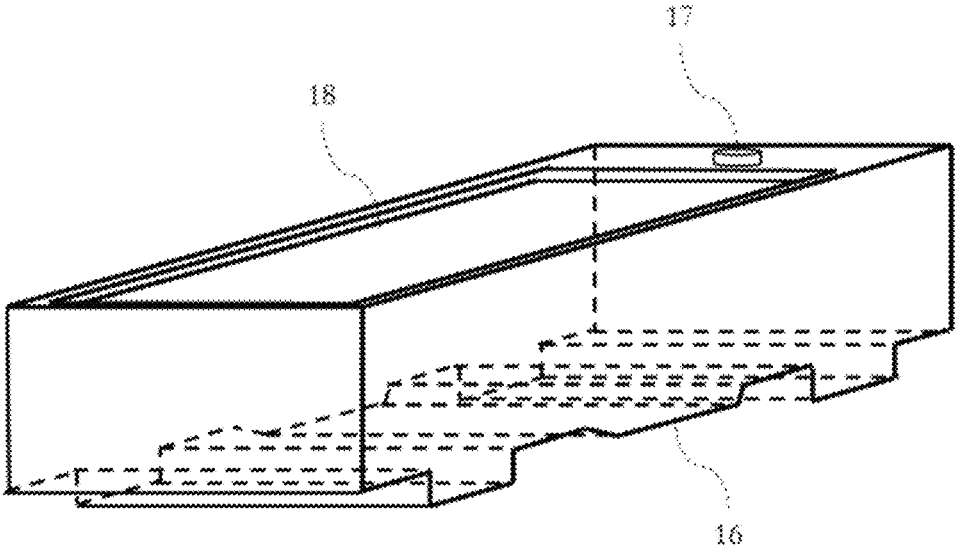
FIG. 6 is a schematic view of an embodiment of a parallelepipedal ingot as understood in the present invention.

Preferably, said ingot 10 is a parallelepiped. The ingot is described as parallelepipedal, but, as represented in FIG. 6, the term "parallelepipedal" includes crenellations 16, attachment means 17, any rim or edges 18 and/or any common ingot geometry. Such crenellations are mainly used for handling purpose, e.g.: for elevating the ingot. Moreover, the ingot shape, a parallelepiped is commonly used and would thus need only minor or no change to the supplying system to be industrially implemented and used. Furthermore, because it does not contain any protuberance nor fragile edges or sections, which might break during the ingot handling and/or addition, the claimed ingot is choc resistant and thus industrially suitable.

Preferably, as illustrated in FIG. 3, said at least one hole (11) extends from a first longitudinal face of said ingot to a second longitudinal face of said ingot being the opposite face of said first longitudinal face.

Preferably, said at least one hole 11 has a cylindrical or conical shape. When the conical shaped hole does not extend from one face to another face, it is preferentially oriented such that the cone base is on the along the ingot surface. It permits to ease the unmoulding of the ingots having a cylindrical or a conical shaped hole because their circumference does not increase along the hole depth.

Preferably, said at least one hole is characterised by a height h, wherein said height h is perpendicular to the ingot length. Having such a hole eases the ingot fragmentation because the surface in the fragmentation plan is smaller thanks to the hole orientation compared to an ingot having a hole with the same geometry (shape and diameter) but with a height not perpendicular to said ingot length. Preferably, all the holes are characterised by a height, wherein said height is perpendicular to said ingot length.

Preferably, said ingot comprises n holes, defining n maximum distance (MaxD1, . . . , MaxDn) and n holes peripheries any point of a hole periphery being spaced from any point of another hole periphery by a distance, noted Sp, that is at least bigger than max(MaxD1, . . . , MaxDn). Spacing the holes by such a distance permits to fragment the ingot into (n+1) parts during the ingot melting and thus increases the melting speed and reduces the formation of an ingot pile.

Figure 7:
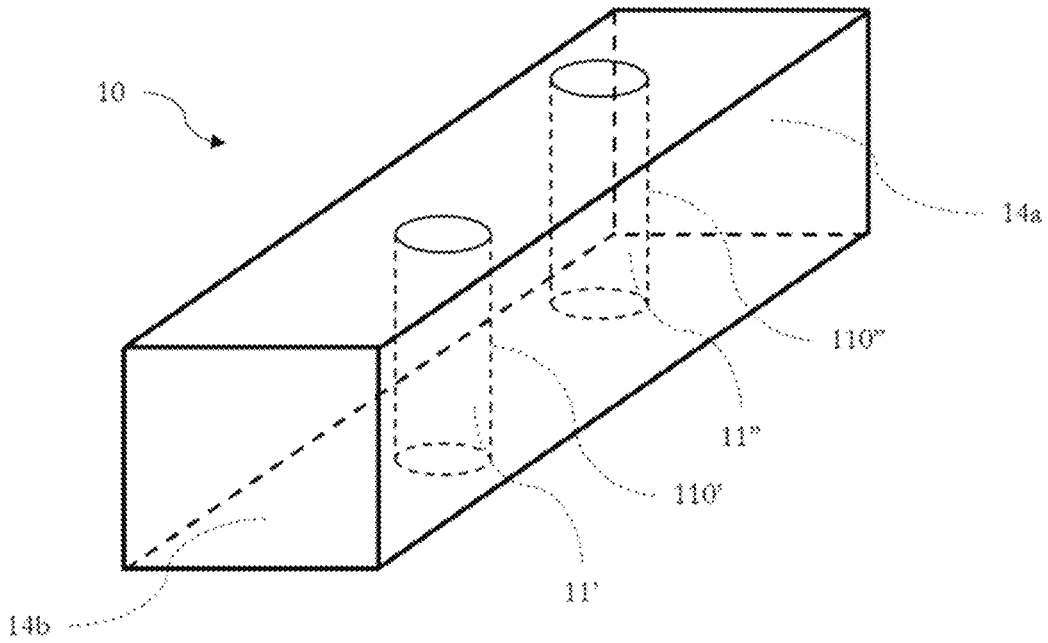
FIG. 7 is a schematic view of an embodiment of the present invention with two holes.
Figure 8:
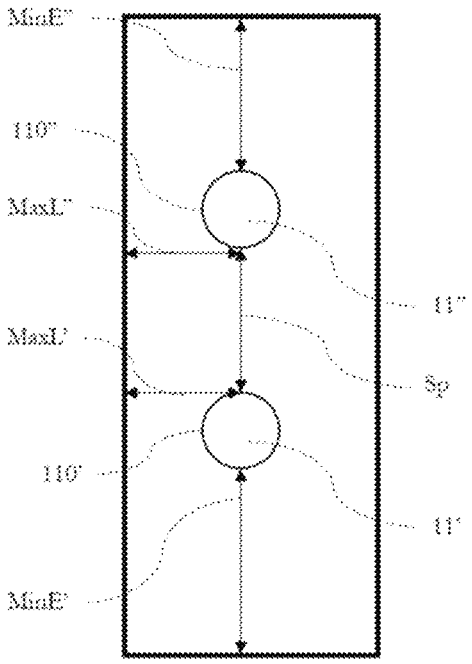
FIG. 8 is a schematic top view of an embodiment of the present invention with two holes.

Preferably, as illustrated in FIGS. 7 and 8 said ingot comprises two holes (11', 11") defining two maximum distances, MaxL' and MaxL", and two holes peripheries (110', 110"), any point of a hole periphery (110') being spaced from any point of another hole periphery (110") by a distance, noted Sp, that is at least bigger than max(MaxL', MaxL"). Spacing the holes by such a distance permits to fragment the ingot into three parts during the ingot melting and thus increases the melting speed and reduces the formation of an ingot pile.

Figure 9:
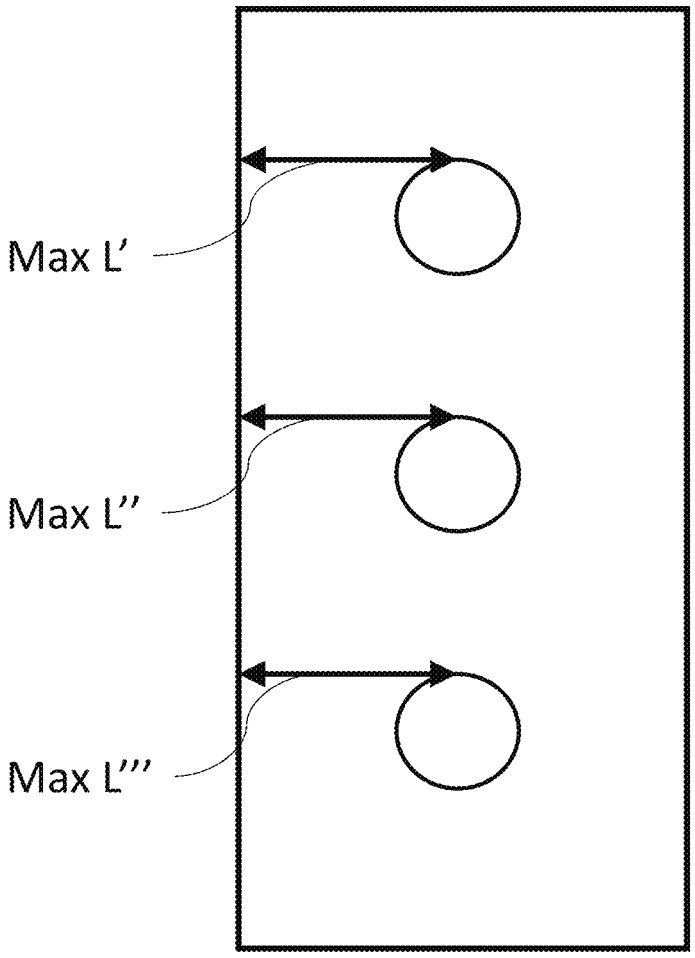
FIG. 9 is a schematic of an embodiment of the present invention with three holes.

Preferably, as shown in FIG. 9, said ingot comprises three holes, defining three maximum distances, MaxL', MaxL" and MaxL'", and three holes peripheries, any point of a hole periphery being spaced from any point of another hole periphery by a distance that is at least bigger than max (MaxL', MaxL", MaxL'"). Spacing the holes by such a distance permits to fragment the ingot into four parts during the ingot melting and thus increases the melting speed and reduces the formation of an ingot pile.

Preferably, said ingot has a volume between 0.15 $m^3$ and 0.40 $m^3$.

Preferably, said ingot has a surface area to volume ratio between 12 $m^{-1}$ and 18 $m^{-1}$. Such a ratio range increases even further the productivity because the lower threshold is increased compared to the previous mentioned range.

The invention also refers to a process for managing a bath level of a molten alloy and reducing the dross formation inside a tank wherein an ingot, according to anyone of claims 1 to 10, is fully immersed into said bath.

What is claimed is:

1. An ingot having a volume between 0.15 $m^3$ and 0.80 $m^3$ and a surface area to volume ratio between 10 $m^{-1}$ and 18 $m^{-1}$, made of at least one metal selected from a group consisting of zinc, silicon, magnesium, aluminum and mixtures thereof, and comprising:

two end faces;

longitudinal faces extending between the two end faces, the longitudinal faces including a first and a second longitudinal face; and at least one hole extending from the first longitudinal faces to the second longitudinal face, the hole having a hole periphery, a maximum distance between any point of the hole periphery, to a closest of the longitudinal faces being defined as MaxL, the at least one hole being configured such that MaxL is smaller than a minimal distance, defined as MinE, between any point of the hole periphery and a closest of the two end faces;

wherein the ingot is a parallelepiped.

2. The ingot as recited in claim 1 wherein the first longitudinal face is opposite the second longitudinal face.

3. The ingot as recited in claim 1 wherein the at least one hole has a cylindrical or conical shape.

4. The ingot as recited in claim 1 wherein the at least one hole includes two holes defining two maximum distances, MaxL' and MaxL", and two hole peripheries, any point of a hole periphery being spaced from any point of another hole periphery by a distance, defined as Sp, that is bigger at least than max(MaxL', MaxL").

5. The ingot as recited in claim 1 wherein the at least one hole includes three holes defining three maximum distances, MaxL', MaxL" and MaxL'", and three hole peripheries, any point of a hole periphery being spaced from any point of another hole periphery by a distance that is at least bigger than max(MaxL', MaxL", MaxL'").

6. The ingot as recited in claim 1 wherein the volume is between 0.15 $m^3$ and 0.40 $m^3$.

7. The ingot as recited in claim 1 wherein the surface area to volume ratio is between 12 $m^{-1}$ and 18 $m^{-1}$.

8. A method for managing a bath level of a molten alloy and reducing the dross formation inside a tank wherein the ingot as recited in claim 1 is fully immersed into said bath.

* * * * *